US009976319B2

(12) United States Patent
Lamke

(10) Patent No.: US 9,976,319 B2
(45) Date of Patent: May 22, 2018

(54) TENT SYSTEM EMPLOYING AN IMPROVED SPIDER HUB AND ASSOCIATED FRAME STRUCTURE AND METHOD OF COMPACTING THE FRAME FOR REDUCED STORAGE SIZE

(71) Applicant: HKD Global Limited, North Point (HK)

(72) Inventor: Samuel F. Lamke, Washington, MO (US)

(73) Assignee: HKD GLOBAL LIMITED, Hong Kong (HK)

( * ) Notice: Subject to any disclaimer, the term of this patent is extended or adjusted under 35 U.S.C. 154(b) by 0 days. days.

(21) Appl. No.: 14/635,672

(22) Filed: Mar. 2, 2015

(65) Prior Publication Data

US 2015/0275541 A1 Oct. 1, 2015

Related U.S. Application Data

(60) Provisional application No. 61/972,899, filed on Mar. 31, 2014.

(51) Int. Cl.
*E04H 15/46* (2006.01)
*E04H 15/32* (2006.01)
*E04H 15/48* (2006.01)

(52) U.S. Cl.
CPC ..... *E04H 15/46* (2013.01); *E04H 15/32* (2013.01); *E04H 15/48* (2013.01)

(58) Field of Classification Search
CPC ..... E04H 15/48; E04H 15/36; E04H 15/34; E04H 15/28; Y10T 403/341; Y10T 403/44; E04B 1/1903; E04B 2001/1957; E04B 2001/3247; E04B 1/32
USPC ..... 135/135, 147, 151–152, 905, 28–30; 403/170–171, 217–219; 52/656.9, 655.1, 52/81.3
See application file for complete search history.

(56) References Cited

U.S. PATENT DOCUMENTS

| | | | | |
|---|---|---|---|---|
| 14,655 A | | 4/1856 | Hartwell | |
| 58,283 A | | 9/1866 | Palmer | |
| 379,274 A | | 3/1888 | Hamilton | |
| 1,502,898 A | * | 7/1924 | Berg | E04H 15/28 135/147 |
| 2,113,118 A | | 4/1938 | Pyatt | |

(Continued)

FOREIGN PATENT DOCUMENTS

| | | |
|---|---|---|
| CA | 2022369 | 2/1991 |
| CN | 1076987 A | 10/1993 |

(Continued)

*Primary Examiner* — Winnie Yip
(74) *Attorney, Agent, or Firm* — Sandberg Phoenix & von Gontard P.C.

(57) ABSTRACT

A frame for a portable structure preferably in the form of a tent includes a hub having a plurality of tent pole frame members attached to it. The each tent pole is formed from a plurality of pole sections interconnected to one another along a structure permitting the pole sections to fold and/or compact upon one another. The poles define a proximate end attached to the hub and a distal end having a locking structure associated with it. The locking structure attaches each pole to the material defining the portable structure. The structure provides a reduced size package in the compacted position of the structure.

14 Claims, 10 Drawing Sheets

(56) References Cited

U.S. PATENT DOCUMENTS

| | | | | |
|---|---|---|---|---|
| 2,306,706 | A | 12/1942 | Lucas | |
| 2,448,895 | A | 9/1948 | Lawrence | |
| 2,530,765 | A | 11/1950 | Greenup | |
| 2,555,220 | A | 5/1951 | Brown | |
| 2,731,972 | A | 1/1956 | Braun | |
| 2,948,287 | A | 8/1960 | Rupert | |
| 2,953,145 | A * | 9/1960 | Moss | E04H 15/28 135/117 |
| 2,962,034 | A | 11/1960 | Finlayson | |
| 2,984,249 | A | 5/1961 | Sears, Jr. et al. | |
| 3,054,413 | A | 9/1962 | Eshelman | |
| 3,181,542 | A * | 5/1965 | Bareis | E04H 15/28 135/139 |
| 3,333,373 | A | 8/1967 | Taylor et al. | |
| 3,738,378 | A | 6/1973 | Williams | |
| 3,794,054 | A * | 2/1974 | Watts | E04H 15/28 135/117 |
| 3,810,482 | A | 5/1974 | Beavers | |
| 3,929,146 | A | 12/1975 | Maiken | |
| 4,077,417 | A | 3/1978 | Beavers | |
| 4,148,332 | A | 4/1979 | Huddle | |
| 4,201,237 | A | 5/1980 | Watts et al. | |
| 4,280,521 | A | 7/1981 | Zeigler | |
| 4,285,354 | A | 8/1981 | Beavers | |
| 4,627,210 | A | 12/1986 | Beaulieu | |
| 4,637,748 | A | 1/1987 | Beavers | |
| 4,750,509 | A | 6/1988 | Kim | |
| 4,787,182 | A | 11/1988 | Serge | |
| 4,819,680 | A | 4/1989 | Beavers | |
| 4,838,003 | A | 6/1989 | Zeigler | |
| 4,941,499 | A | 7/1990 | Pelsue et al. | |
| 4,966,178 | A | 10/1990 | Eichhorn | |
| 4,971,090 | A | 11/1990 | Uhl | |
| 5,195,551 | A | 3/1993 | Ju | |
| 5,293,890 | A | 3/1994 | Park et al. | |
| 5,328,286 | A | 7/1994 | Lee | |
| 5,333,634 | A | 8/1994 | Taylor | |
| 5,361,794 | A | 11/1994 | Brady | |
| 5,423,341 | A | 6/1995 | Brady | |
| 5,617,681 | A | 4/1997 | Lyons | |
| 5,628,338 | A | 5/1997 | Stumbo | |
| 5,634,483 | A | 6/1997 | Gwin | |
| 5,666,986 | A | 9/1997 | Fox | |
| 5,732,726 | A | 3/1998 | Lee | |
| 5,797,695 | A | 8/1998 | Prusmack | |
| 5,884,646 | A * | 3/1999 | Ju | E04H 15/42 135/124 |
| 5,943,837 | A | 8/1999 | Esser et al. | |
| 6,021,795 | A | 2/2000 | Long et al. | |
| 6,032,430 | A | 3/2000 | Soukup | |
| 6,167,898 | B1 | 1/2001 | Larga et al. | |
| 6,286,530 | B1 | 9/2001 | Hussey | |
| 6,296,415 | B1 | 10/2001 | Johnson et al. | |
| 6,516,823 | B1 | 2/2003 | Glover et al. | |
| 6,591,571 | B2 | 7/2003 | Fritsche et al. | |
| 6,604,844 | B2 | 8/2003 | Hussey | |
| 6,666,223 | B2 | 12/2003 | Price et al. | |
| 6,679,643 | B1 * | 1/2004 | Ham, II | E04H 15/48 135/126 |
| 6,772,780 | B2 | 8/2004 | Price | |
| 6,776,179 | B1 | 8/2004 | Chen | |
| 6,854,476 | B1 | 2/2005 | Chai | |
| 6,868,858 | B2 | 3/2005 | Suh | |
| 6,874,519 | B2 | 4/2005 | Chiang | |
| 6,892,744 | B2 | 5/2005 | Feldpausch et al. | |
| 7,025,075 | B2 | 4/2006 | Suh | |
| 7,040,585 | B2 | 5/2006 | Cheng et al. | |
| 7,059,094 | B2 | 6/2006 | Yamawaki | |
| D544,941 | S | 6/2007 | Rogers | |
| 7,311,113 | B2 | 12/2007 | Suh | |
| RE40,544 | E | 10/2008 | Suh | |
| 7,481,235 | B2 | 1/2009 | Prusmack | |
| 7,546,845 | B2 | 6/2009 | Prusmack | |
| 8,590,554 | B2 * | 11/2013 | Choi | E04H 15/48 135/120.2 |
| 8,701,688 | B2 * | 4/2014 | Vaughn | E04H 15/16 135/94 |
| 8,925,565 | B2 | 1/2015 | Choi | |
| 2003/0005953 | A1 | 1/2003 | Erbetta et al. | |
| 2007/0051399 | A1 | 3/2007 | Jung | |
| 2007/0151588 | A1 * | 7/2007 | Yul | E04H 15/10 135/91 |
| 2007/0215192 | A1 | 9/2007 | Hoffman | |
| 2014/0238456 | A1 * | 8/2014 | Jin | E04H 15/48 135/147 |
| 2015/0068573 | A1 * | 3/2015 | Jin | E04H 15/42 135/147 |
| 2015/0240513 | A1 * | 8/2015 | Fang | E04H 15/48 135/120.3 |
| 2015/0284974 | A1 * | 10/2015 | Choi | E04H 15/32 135/120.3 |
| 2015/0330099 | A1 * | 11/2015 | Zhou | E04H 15/48 135/143 |

FOREIGN PATENT DOCUMENTS

| | | | |
|---|---|---|---|
| CN | 2506736 | Y | 8/2002 |
| CN | 2635827 | Y | 8/2004 |
| CN | 201129060 | Y | 10/2008 |
| GB | 2201703 | A | 9/1988 |
| GB | 2259927 | A | 3/1993 |

* cited by examiner

TENT SYSTEM EMPLOYING AN IMPROVED SPIDER HUB AND ASSOCIATED FRAME STRUCTURE AND METHOD OF COMPACTING THE FRAME FOR REDUCED STORAGE SIZE

CROSS REFERENCE TO RELATED APPLICATIONS

This application claims priority to Provisional Application No. 61/972,899 filed Mar. 31, 2014, the disclosure of which is incorporated herein by reference.

STATEMENT REGARDING FEDERALLY SPONSORED RESEARCH OR DEVELOPMENT

Not Applicable.

BACKGROUND OF THE INVENTION

This disclosure is directed to portable structures. While the descriptions of various embodiments are concerned generally with camping tents, for example, those skilled in the art will recognize the wider applicability of the inventive features disclosed hereinafter.

The prior art is replete with tent constructions all allegedly making it easy to at least erect the tent structure. Among those constructions are self-erecting popup tents and umbrella tents, for example. While the art in general makes erecting the tent relatively easy, folding the tent for storage is not often accomplished with the same ease. There also has been a need to develop a frame system which can be folded, stored and shipped in a reduced sized package. The product package then must be easy to open and the enclosed structure must be easy to erect by the eventual customer, and repackaged by that customer after use.

The reduction in size of the folded structure is an important consideration for a manufacturer and the manufacturer's customers, commonly retail locations having displays of the product for sale and/or internet sites having associated storage facilities which ship the product to the final consumer. Merely by way of example, with a dome style tent of the present disclosure, a typical forty foot shipping container will hold 1,760 pieces of a thirty inch package, versus 1425 pieces of the longer prior art construction designs. Customers commonly use twelve foot in length storage shelves. Again, the smaller thirty inch package increases storage capacity by twenty five percent, versus the prior art package size of thirty seven inches. That kind of reduction is an important consideration with the designs described herein. Shipping or package size also is important to the final retail customer or buyer, because the retail customer is faced with the same transportation and storage issues, although those issues are associated with only a single package instead of storage and display of a number of product units.

In addition, cost of the various mechanisms employed in the tent construction is an important consideration. That is to say, both the initial cost for the parts themselves and their assembly must be reasonable in order to provide a realistic price point for a manufacturer and the ability to replace parts of the tent frame, which may become damaged in use, must be easy to accomplish for warranty purposes.

This disclosure describes in one illustrative embodiment the use of a spider hub structure main body having a plurality of legs extending outwardly from the body. Preferably each leg of the hub has a tent pole interconnected to the hub structure on one end of the poles. Each of the tent poles are assembled from a plurality of pole sections. The pole sections are interconnected to one another along a novel arrangement in several illustrative embodiments enabling the hub structure to be used across a range of tent products. A particular feature of those products is the reduced length of the stored assembly.

In any event, the pole sections together define a tent pole having a proximate end connected to the hub and a distal end in ground supporting relationship for the frame structure. In one embodiment, preferably at least the distal pole section has first and second parts which telescope within one another allowing their extension during deployment and re-engagement within one another for storage. Depending on the tent size and/or configuration, the hub may have a variety of tent poles associated with it. The pole sections preferably are fiberglass although other materials may be used, if desired. Commonly the pole sections which telescope within one another are metal, for example. The distal end pole section has a locking mechanism associated with it which permits the poles to be connected to the material of the portable structure as later described.

A feature of the construction is that the frame structure always is attached to or associated with the material forming the portable structure, commonly a tent. As will be appreciated, because all of the components of the frame system are always associated with the tent material, loss of component parts is eliminated while replacement of individual components of the frame is accomplished easily.

The structure is easy to set up for use and disassembles or compacts easily for storage. Another particular feature of the present disclosure is that the tent structure is relatively self-erecting across a variety of tent configurations. When extended from their stored position, the tent poles and hub act to raise the tent frame to its intended deployed position.

Also disclosed are structures for accomplishing and methods for compacting and/or folding the tent poles for storage, the stored position, the compacted package having a reduced package length.

SUMMARY OF THE INVENTION

In accordance with this disclosure, generally stated, a frame structure system for a portable structure, preferably in the form of a tent, is provided having a flexible material associated with or attached to the frame structure system. The flexible material forms the shape for the portable structure or tent. The frame structure system includes a spider hub body having a plurality of legs extending outwardly from it. Each tent pole associated with a particular tent design is interconnected with one of the legs of the spider hub body. The tent poles have a proximate end and a distal end. The hub legs define a plurality of receptacles formed to receive the proximate end of an associated tent pole. The distal end of the tent pole includes a locking mechanism for attaching the pole to the flexible material. Each of the tent poles preferably is formed by a plurality of pole sections. The pole sections are joined to one another along a hinge arrangement permitting the pole sections to be folded together for storage. The distal end pole section has a self-locking telescoping portion which extends during deployment of the portable structure. A structure and method for providing a reduced size storage package also is provided. Preferably, a tent fly is positioned over the flexible material and the flexible material is attached to the tent fly if desired. By changing the construction of the tent poles associated with the accompanying hub, and altering the number of legs associated with the hub if required, the frame system is adaptable to and provides a variety of portable structure variations.

BRIEF DESCRIPTION OF THE SEVERAL VIEWS OF THE DRAWINGS

The objects of the invention are achieved as set forth in the illustrative embodiments shown in the drawings which form a part of the specification.

Referring now to the Drawings.

Figure 1:
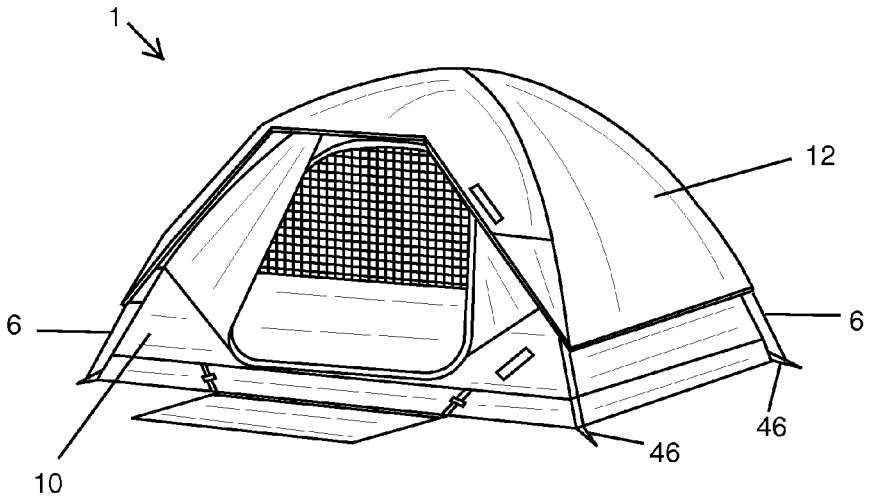
FIG. 1 is a view in perspective of one illustrative embodiment for portable structure of the present disclosure.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Corresponding reference numerals refer to common structures where appropriate.

Referring now to FIG. 1, reference numeral 1 indicates one illustrative embodiment of a portable structure in the form of a tent with which one illustrative frame system of the present disclosure finds application. The structure 1 shown in FIG. 1 is in a form commonly known as a dome tent. The structure 1 includes a frame 4 including a plurality of tent poles 6 associated with a hub 8. A flexible material 10 is associated with the frame 4 to define or delimit the boundaries of for the portable structure 1. A rain fly 12 commonly is associated with the portable structure, as later described in greater detail.

Figure 6:
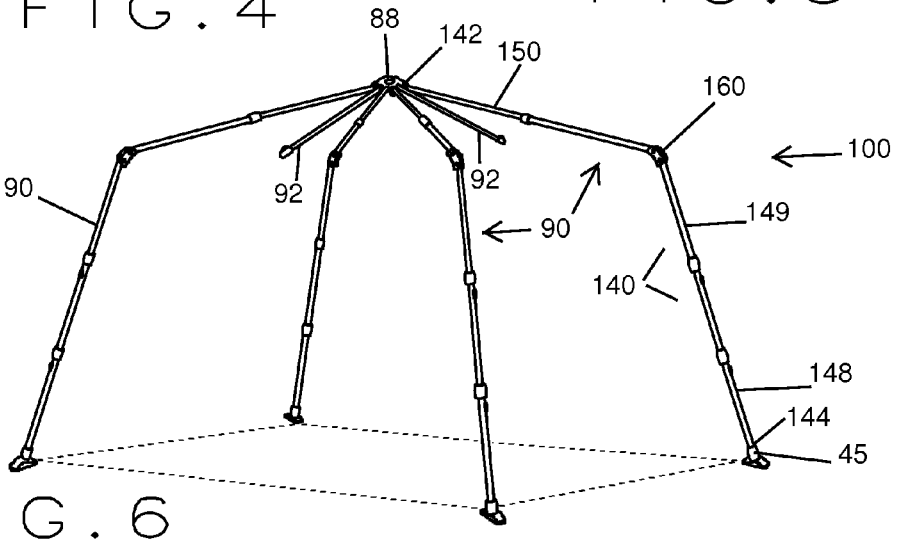
FIG. 6 is a view in perspective of second illustrative embodiment of frame structure of the present disclosure.

It is a feature of the present disclosure that the frame 4 may be modified to provide various configurations of the portable structure 1. A second illustrative embodiment of a portable structure 100 is shown in FIG. 6 in a configuration commonly known in the art as a cabin tent. Particular features of the various portable structure modifications are described in greater detail hereinafter.

Figure 3A:
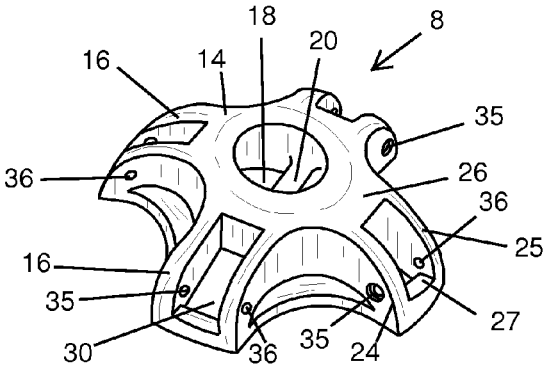
FIG. 3A is a top view in perspective of one illustrative embodiment of hub structure employed with the embodiment of FIGS. 1 and 2.
Figure 3B:
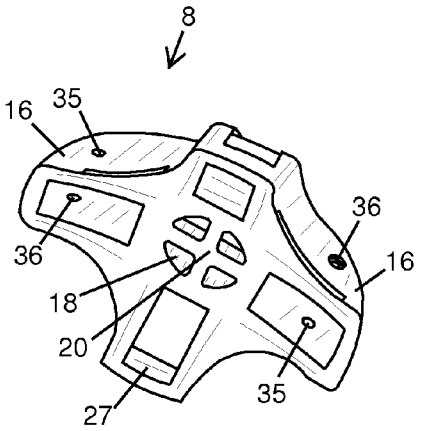
FIG. 3B is a bottom view in perspective of the hub structure of FIG. 3A.
Figure 4:
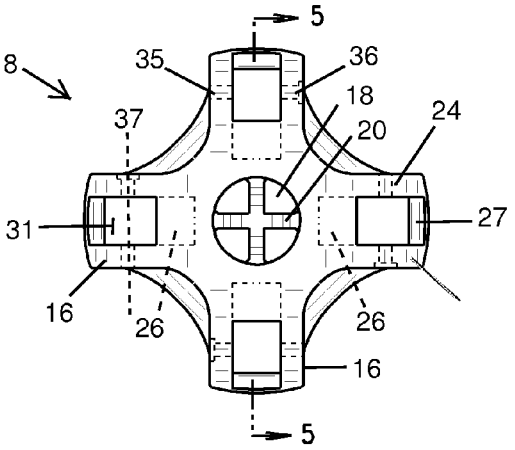
FIG. 4 is a top plan view of the hub structure shown in FIGS. 3A and 3B.
Figure 5:
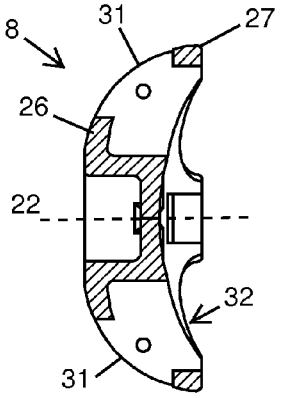
FIG. 5 is a sectional view taken along the line 5-5 in FIG. 4.

As is best seen in FIGS. 3 through 5, the hub 8 preferably is a spider like configuration having a main body part 14. The body part 14 has a plurality of legs 16 extending outwardly from it. The body part 14 preferably has a cylindrically shaped opening 18 extending through it. The opening 18 is partially closed on its bottom side by an attachment cross bar 20. The cross bar 20 is used to attach the flexible material 10 defining the tent enclosure to the hub 8. Attachment may be accomplished by any convenient method. Commonly, a drawstring arrangement is used to attach the flexible material 10 to the hub 8. Other attachment methods will be apparent to those skilled in the art and a variety of methods are compatible with the broader aspects of this disclosure. The hub 8 preferably is symmetrically arranged about a central axis 22.

The legs 16 are identical to one another in construction details and only a single leg 16 is described in detail. The number of legs can vary in other embodiments of the disclosure, but commonly the number of legs 16 associated with the body 14 corresponds at least to the number of tent poles used to support the flexible material 10 in the erected position of the portable structure 1, for example. In any event, each leg 16 of the hub 8 is formed by a pair of downwardly extending curved walls 24 and 25 joined together at their upper ends by a lip 26 formed by the body 14 and by an edge or lip 27 extending between the walls 24 and 25 at the lower ends of the walls. For the purposes of this specification, the terms edge and lip with respect to the reference numerals 26 and 27 are intended to convey similar meaning in functional operation. As may be noted with reference to FIG. 5, lip 26 is axially offset from the edge or lip 27. The offset is important as later described in that the poles 6 act as a lever in relationship to the hub 8, aiding in the ability of the poles 6 to aid a user in erecting the potable structure to its normally raised position shown, for example in FIG. 1. The walls 24 and 25 together with the lip 26 and the edge 27 define a channel 30 extending through the respective legs 16. The channel 30 has a mouth 31 sized to receive an upper end termination 33 of the tent pole 6 associated with the particular leg 16, and an exit void 32 sized to permit the end termination 33 to rotate between an extended position for each leg 16 and a stored or compacted position for each or the legs 16 as later described.

Each wall 24 and 25 has one of a pair of aligned openings 35 and 36 formed in one of the respective walls which permits attachment of the end 33 of each tent pole 6 to its respective leg 16 along an axis or rotation indicated by reference numeral 37. Commonly, convention rivets or screw and bolt arrangements are used to attach the end 33 of the poles 6 to the legs 16 along the axis 37. Other connection arrangement will be apparent to those skilled in the art so long as the indicated rotation is provided by the interconnection.

Figure 2:
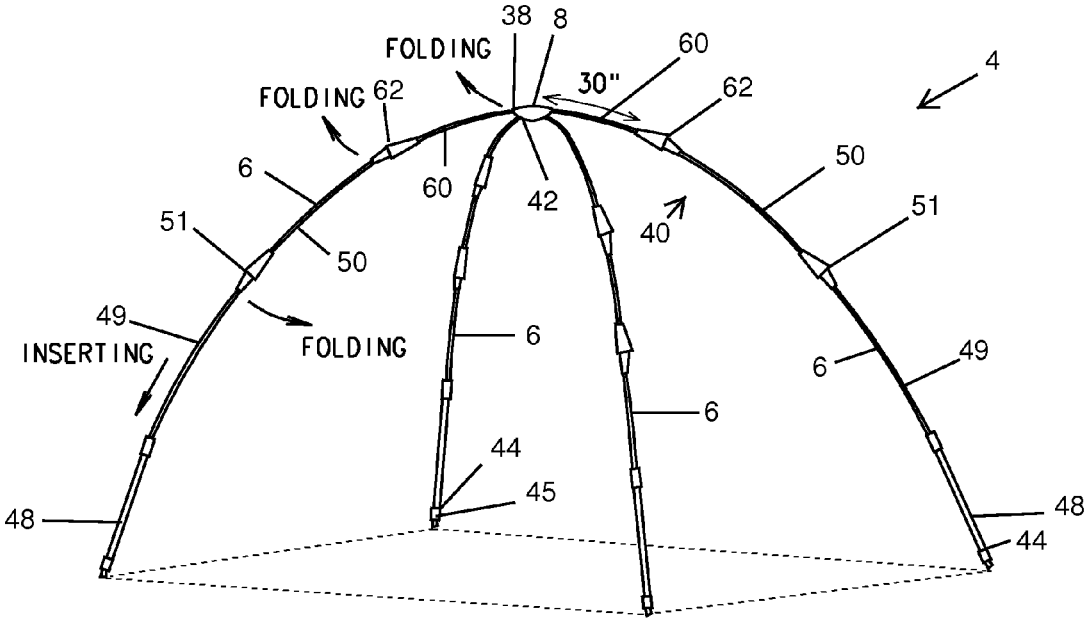
FIG. 2 is a view in perspective of one illustrative embodiment of frame structure employed with the embodiment of FIG. 1.

As suggested above, the hub construction described can be extended across a line of portable structure 1 designs with relatively minor changes in the hub structure. The hub preferably is a molded part the configuration of which can be altered as needed to accommodate other designs for the portable structure 1. The tent illustrated in FIG. 1 is known in the art as a dome tent and the frame structure 40 for that design is shown in FIG. 2. The combination of the frame structure 40 and hub 8 provides a novel combination that permits the frame structure 40 to be compacted into a reduced size package for storage.

Referring to FIG. 2, the frame structure 40 comprises four of the tent poles 6. Each of the poles 6 is similar to one another in the embodiment illustrated, and one of the poles 6 is described in detail. Those skilled in the art will recognize the other tent poles 6 are similar in constructional features. Each of the poles 6 has a proximate end 42 and a distal end 44. The proximate end 42 in the embodiment of FIG. 2 is terminated at its end 33 by a housing 65 (FIG. 10 A) described in greater detail below. The distal end 44 is terminated in a t-clip connector 45 which is inserted into a ground stake strap 46 (FIG. 1). The strap 46 also is attached to the material 10 and the connector 45. While the connector 45 is removable from the strap 46, normally it remains attached during erecting of the structure 1 for use and folding of the structure 1 for storage.

Each of the tent poles 6 for the embodiment shown in FIG. 2 is arranged in four sections or stages. For purposes of this disclosure, a first stage 48 is associated with the distal end 44 of the pole 6. Stage 48 is connected to a second stage 49 in a telescoping arrangement so that stage 49 is at least partially inserted in stage 48 for storage and extended for use. Telescoping members similar to the stages 48 and 49 are known in the art and a detail description of the telescoping mechanism is believed to be unnecessary. Typically the mechanism locks the parts in a first extended position and a button release is provided to close the parts together.

Figure 20:
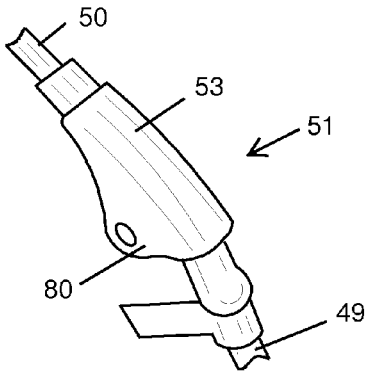
FIG. 20 is an enlarged view in perspective of the connection of the telescoping lower portion (first stage) of the tent pole employed with the embodiment of FIG. 2 requiring counterclockwise rotation of the first stage with the second stage of the tent pole.
Figure 21:
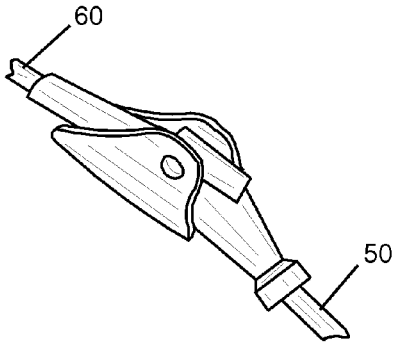
FIG. 21 is an enlarged view in perspective of the connection between the second stage and the third stage and the third stage and fourth stage of the tent pole requiring clockwise rotation of the stages for obtaining the stored location of the respective pole.
Figure 22:
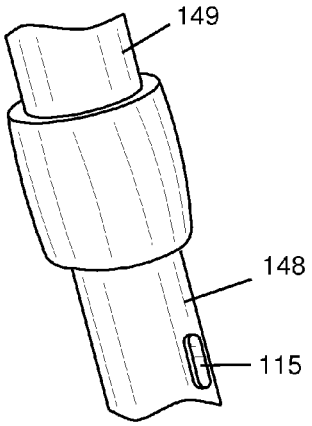
FIG. 22 is an enlarged view in perspective of the connection of the telescoping lower portion (first stage) of the tent pole employed with the embodiment of FIG. 6.
Figure 23:
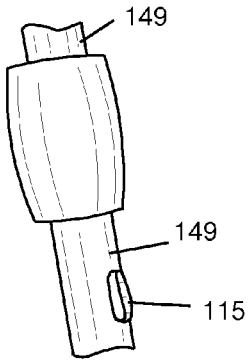
FIG. 23 is an enlarged view in perspective of the connection of the telescoping (second stage) of the tent pole employed with the embodiment of FIG. 6.
Figure 24:
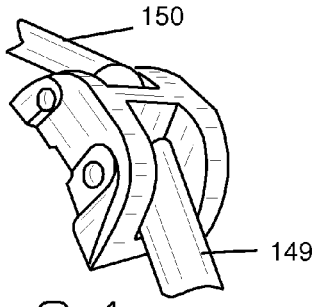
FIG. 24 is an enlarged view in perspective of the connection between the second stage and a third stage of the tent pole employed with the embodiment of FIG. 6 requiring clockwise rotation of the stages for obtaining the stored location of the respective pole.
Figure 25:
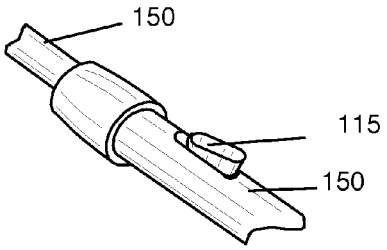
FIG. 25 is an enlarged view in perspective of the telescoping third stage of the tent pole employed with the embodiment of FIG. 6.
Figure 26A:
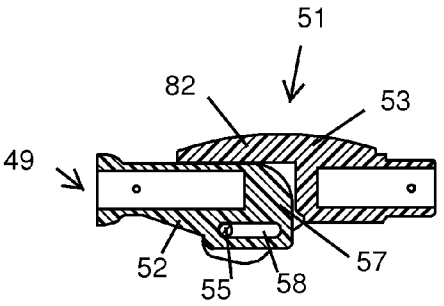
FIGS. 26A-26G are diagrammatic sectional views of the tent pole interconnection shown in FIG. 20 illustrating operation of the interconnection.
Figure 26B:
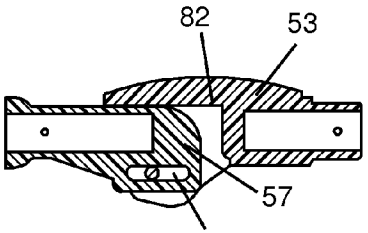
Figure 26C:
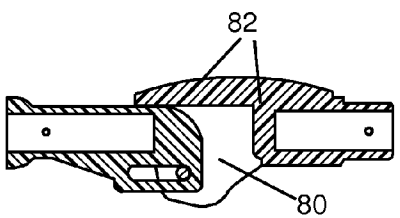
Figure 26D:
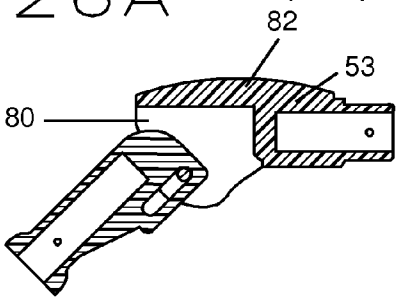
Figure 26E:
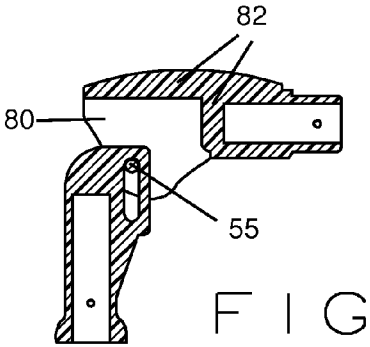
Figure 26F:
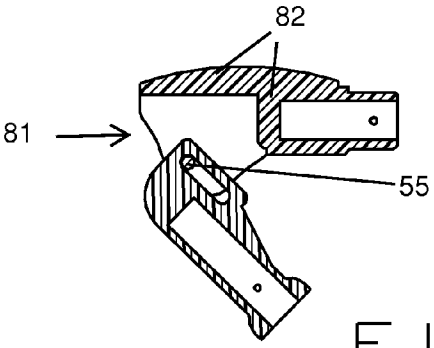
Figure 26G:
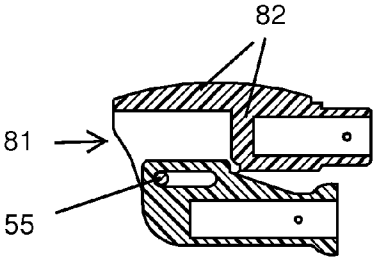

Stage 49 then is attached to a stage 50 along a joint connection 51. As best seen in FIGS. 20 and 26 A-G, connection 51 comprises a two part assembly. One piece of the assembly is a connector body 53. Connector body 53 has a first end composed of a pair of parallel walls 80 defining a channel 81 sized to receive a second piece of the assembly in the form of an end piece 52 attached to the stage 49. A second end of connector body 53 is attached to the stage 50. Connector body 53 also defines a stop 82 which prevents both clockwise and counterclockwise rotation of the end piece 52 in the position shown in FIG. 26A, the extended position of the tent pole 6.

Referring to FIG. 26, end piece 52 is received in channel 81 of connector body 53 and is rotatably connected to the connector body 53 by a pin 55. As will be appreciated, end piece 52 receives an end of the stage 49 and is attached to the stage 49 by any convenient method. Conventional screw and bolt combinations work well, for example. End piece 52 includes a body 57 having an elongated slot 58 formed in it. Slot 58 receives or is interconnected to the connector body 53 along the pin 55. The interconnection and operation of the joint 51 has an important function. When the end piece 52 is fully inserted in the connector 53, rotation about the pin 55 in either a clockwise or counterclockwise direction about the pin 55 is prevented by the stop 82. However, by moving the end piece 52 outwardly along the slot 54/pin 55 connection, counterclockwise rotation of stage 49 about the pin 55 is permitted in moving the frame structure 40 from the extended position shown in FIG. 2-FIG. 26A to its stored position. When fully inserted in the connector 53, further clockwise rotation about the pin 55 in the extended position shown in FIG. 2 is prevented by the stop 82 of the connector 53. In addition, when the end piece 52 is fully inserted the connector 52, the stages 49 and 50 are locked in position and rotation in either clockwise or counterclockwise rotation is prevented. In any event, the actions of inserting the stages 48 and 49 together and folding those stages counterclockwise is important in the folding operation.

Figure 12A:
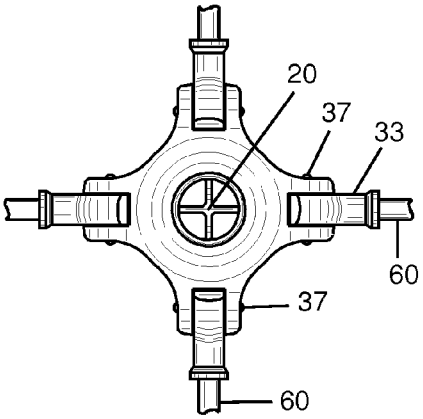
FIG. 12A is a view in perspective, partly broken away, of the open configuration for the frame system shown in FIG. 2.
Figure 12B:
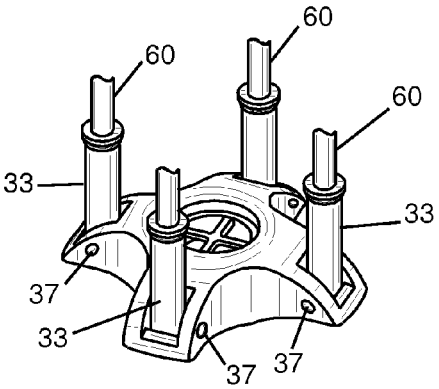
FIG. 12B is a view in perspective of the closed or stored position, partly broken away, of the closed or stored configuration for the frame system shown in FIG. 2.
Figure 13:
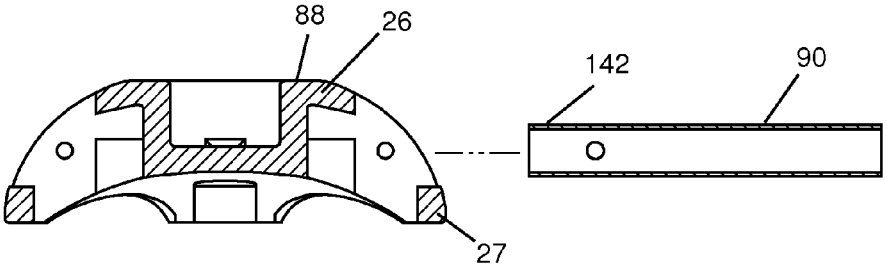
FIG. 13 is a diagrammatic sectional view corresponding to FIG. 9 of a tent pole, partly broken way, showing a second illustrative hub/tent pole interconnection.
Figure 14A:
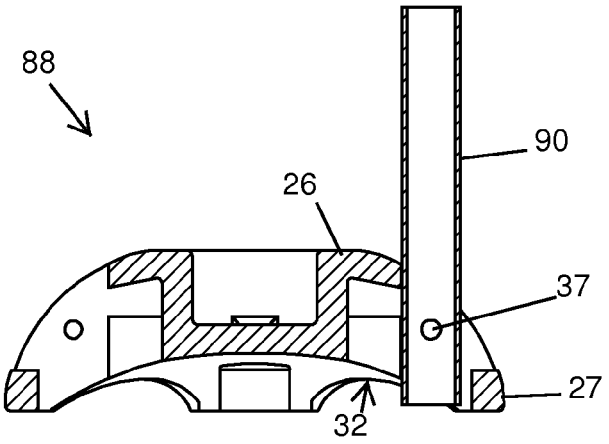
FIGS. 14A-14D are diagrammatic sectional views showing the operative interaction between the tent pole with the hub shown in FIG. 13.
Figure 14B:
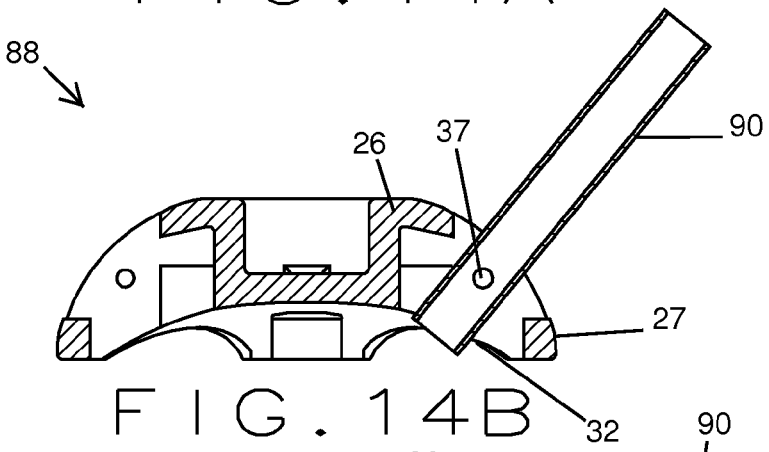
Figure 14C:
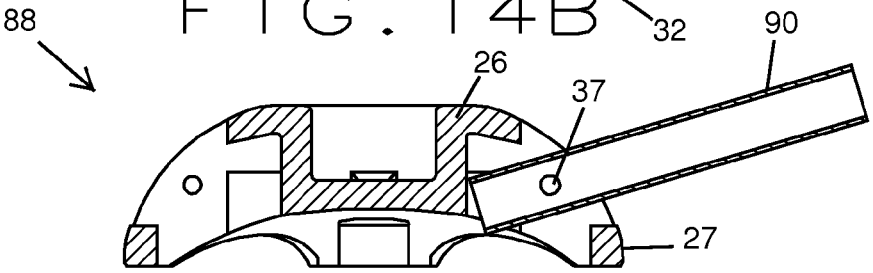
Figure 14D:
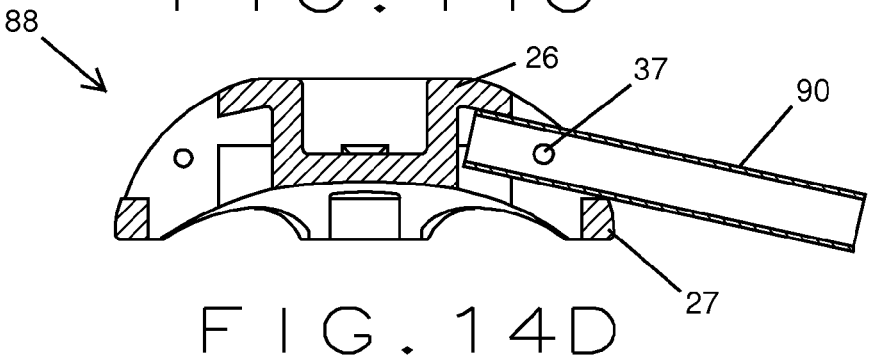
Figure 15A:
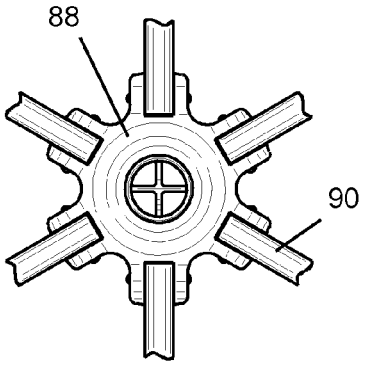
FIG. 15A is a view in perspective, partly broken away, of the open configuration for the frame system shown in FIG. 6.
Figure 15B:
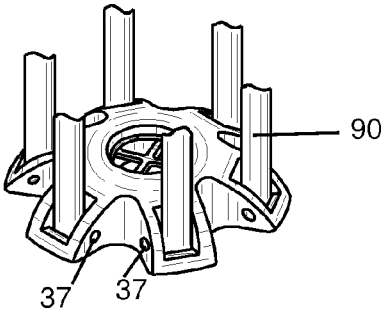
FIG. 15B is a view in perspective of the closed or stored position, partly broken away, of the closed or stored configuration for the frame system shown in FIG. 6.

Stage 50 in turn is connected to a stage 60 along a joint connection 62. Joint connection 62 is arranged to permit rotation about the joint. Stage 60 of the pole 6 defines the proximate end 42 of the pole 6 at the termination 33 which also is rotatably mounted to the hub 8 and permits both clockwise and counterclockwise rotation. Consequently, the construction permits stage 48 and 49 to combine telescopically. Stages 48 and 49 are then rotated counterclockwise into juxtaposed or adjacent position with stage 50. Stages 48, 49 and 50 then all are rotated clockwise into juxtaposed or adjacent position with stage 60 and stages 48, 49, 50 and 60 are again rotated clockwise to a vertical position above hub 8. FIGS. 12A and 12B illustrate the extended and stored position of the poles 6 with respect to the hub 8.

Figure 10A:
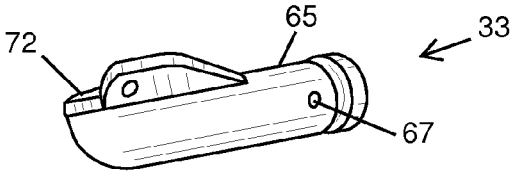
FIG. 10A is a view in perspective of an illustrative embodiment for end termination for the tent poles employed with certain illustrative embodiments of the frame structure of the present disclosure.
Figure 10B:
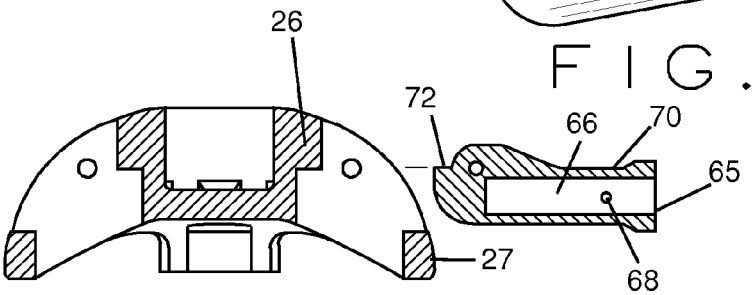
FIG. 10B is a diagrammatic sectional view of the end termination of FIG. 10A adjacent a cross section of the hub shown in FIG. 5.
Figure 11A:
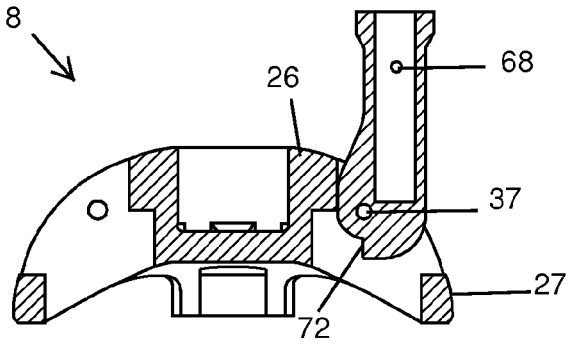
FIGS. 11A-11D are diagrammatic sectional views showing the interaction between the end termination of FIG. 10A with the hub shown in FIGS. 3A and 3B.
Figure 11B:
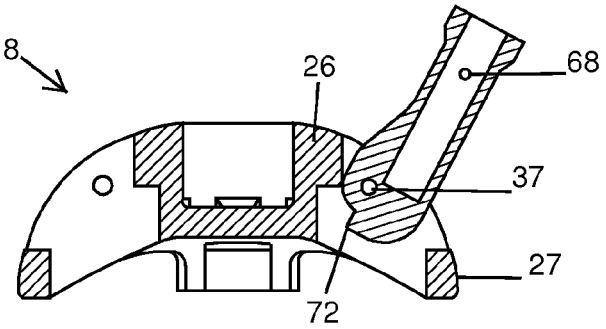
Figure 11C:
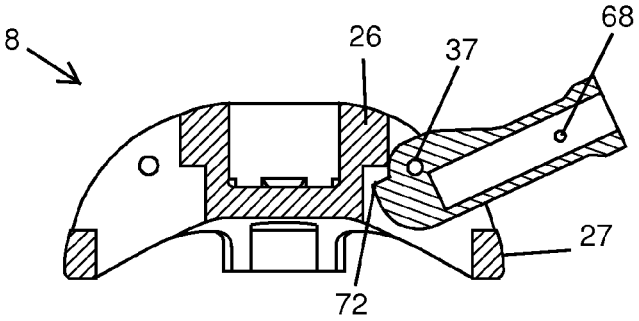
Figure 11D:
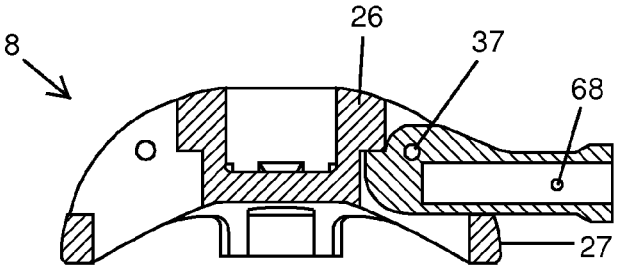

Preferably for the embodiment of FIG. 2, the end 33 termination of the pole 6 is a housing 65, shown in FIGS. 10A and 10B. Housing 65 has an axial opening 66 formed in it, sized to receive the pole 6. As shown the housing 65 preferably is attached to the pole 6 by conventional fasteners 67 through aligned openings 68 in the pole 6 and housing 65. An external surface 70 of the housing 65 has a flat 72 formed in it. Referring to FIGS. 11A to 11D, the stored position of the frame system 4 is illustrated by the FIG. 11A. To erect the portable structure 1, the hub 8 is placed on a supporting surface, and each of the poles 6 is rotated to a generally horizontal position (FIG. 11 D). As the housing 65 and its associated pole 6 is rotated, the flat 72 of the surface 70 meets and engages the lip 26 of the hub 8 while the surface 70 meets and engages the edge 27 of the leg 16. As indicated above, the lip 26 and the edge 27 are offset axially with respect to one another along the axis 22 of the hub 8. The pole sections or stages are opened to their extended position in reverse order of the order described above. The result is that each of the poles 6, in their extended position, forms a long lever arm with respect to the hub 8 which enables a user to raise the portable structure 1 to its deployed position with relative ease.

As indicated, erecting the portable structure 1 procedure is generally opposite to the folding operation discussed above. Again for the sake of simplicity, only the operation for a single pole is described, the operation of the remaining poles being similar. The stages 60 and 50, 49 and 48 are rotated outwardly from the hub 8. Stage 49 is inserted to it locked position with respect to the pin 55, connector 53 position. In that position, the pole 6 will assume or begin to act as a lever on the hub 8. When each of the poles 6 is in a similar position, stages 48 and 49 are extended telescopically and the hub 8 will reach its deployed position.

Figure 7A:
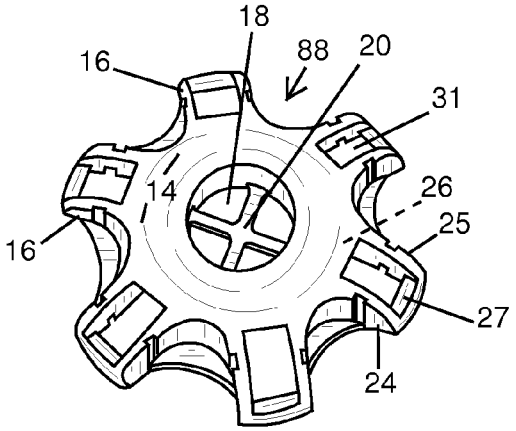
FIG. 7A a is a top view in perspective of second illustrative embodiment of hub structure employed with the embodiment of FIG. 6.
Figure 7B:
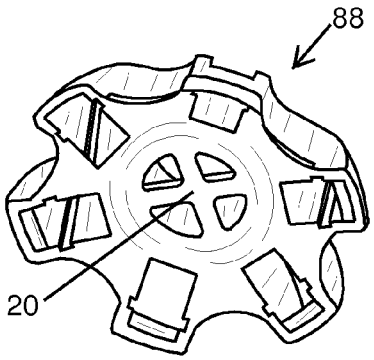
FIG. 7B is a bottom view in perspective of the hub structure shown in FIG. 7A.
Figure 8:
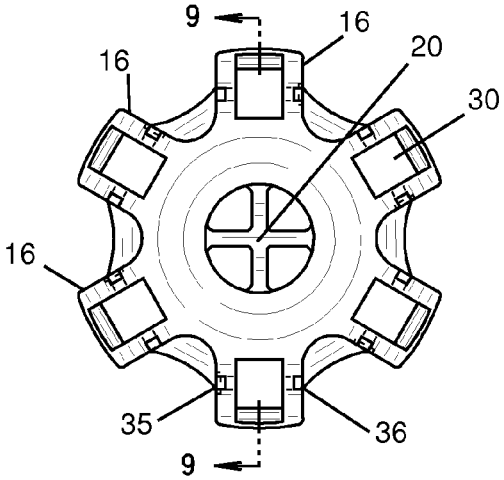
FIG. 8 is a top plan view of the hub structure shown in FIGS. 7A and 7B.
Figure 9:
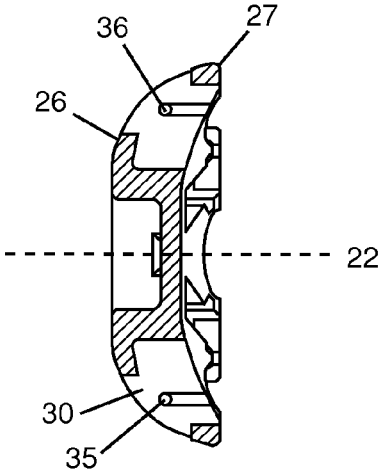
FIG. 9 is a sectional view taken along the line 9-9 of FIG. 8.

Referring now to FIG. 6, a second embodiment for the portable structure 100 using a modified hub 88 is shown in the form of what is known in the art as a cabin tent. The hub 88 employed with the embodiment of FIG. 6 generally is similar to the hub 8, and common reference numerals are used for similar components where appropriate. In particular, hub 88, as is best seen in FIGS. 7 through 9, preferably is a spider like structure having a main body part 14 having a plurality of legs 16 extending outwardly from it. The body part 14 preferably has a cylindrically shaped opening 18 extending through it. The opening 18 is partially closed on its bottom side by an attachment cross bar 20. The cross bar 20 is used to attach the flexible material defining the tent enclosure to the hub 88. The hub 88 preferably is symmetrically arranged about a central axis 22.

The legs 16 are identical to one another and only a single leg 16 structure is described in detail. The number of legs can vary in other embodiments of the disclosure, but commonly the number of legs 16 associated with the body part 14 corresponds to the number of tent poles 90 used to support the flexible material 10 in the erected condition of the portable structure 100. Here the hub 88 has six legs extending outwardly from it. Four of the legs receive associated tent poles 90 and the additional legs receive two additional supports 92. In any event, each leg of the hub 88 is formed by a pair of downwardly extending curved walls 24 and 25 joined together at their upper ends by a lip 26 formed by the body 14 and by an edge or lip 27 extending between the walls 24 and 25 at the lower ends of the walls. As may be noted with reference to FIG. 9, lip 26 is axially offset from the edge 27. The offset is important again, because the poles act as lever arms in relationship to the hub 88, aiding a user in the user's ability to erect a frame structure 140 to its normally raised position shown, for example, in FIG. 6. The walls 24 and 25 together with the lip 26 and the edge 27 define a channel 30 extending through the respective legs 16. The channel 30 has a mouth 31 sized to receive an upper end 33 of the tent pole 90 associated with the particular leg 16, and an exit void 32 sized to permit the end 33 to rotate between and extended position for each tent pole 90 and a stored or compacted position for each of the tent poles 90 as later described.

Each wall 24 and 25 has a pair of aligned opening 35 and 36 which permits attachment of the end 33 of each tent pole 90 to its respective leg 16 along an axis or rotation indicated by reference numeral 37. Various connection arrangements will be apparent to those skilled in the art.

In the cabin tent embodiment, the end 33 of the pole 90 is directly attached to the Hub 88. That attachment is diagrammatically indicated in FIG. 13 and the operation of the poles 90 and hub 88 between a stored position and an extended position as shown in FIGS. 14A thru 14D. Operation is essentially the same as described with respect to pole 6, except the pole 90 does not employ the housing 65 end termination. As will be appreciated, the use or non-use of the housing 65 in any particular embodiment is a matter of choice.

Again referring to FIG. 6, one illustrative embodiment of cabin tent fame structure 140 comprises four of the tent poles 90. Each of the poles 90 is similar to one another in the embodiment illustrated, and one of the poles 90 is described in detail. Those skilled in the art recognizing the construction/arrangement of the other tent poles 90 are similar. If desired, additional structure or supports not shown may be utilized to support a rain fly structure (not shown) in conjunction with the frame structure 140 in other embodiments of the disclosure.

Figure 18:
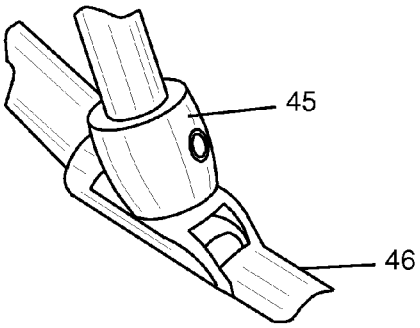
FIG. 18 is an enlarged view in perspective of the distal end of an illustrative tent pole employed with the embodiments of FIGS. 2 and 6.
Figure 19:
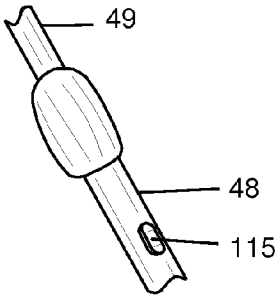
FIG. 19 is an enlarged view in perspective of the telescoping lower portion of the tent pole employed with the embodiment of FIG. 2.

Each of the poles 90 has a proximate end 142 and a distal end 144. The distal end 144 is terminated in a t-clip connector 45 which is inserted into a ground stake strap 46 (FIG. 18). The strap 46 also is attached to the material 10 and the connector 45, while removable from the strap 46, normally remains attached during erecting of the structure 1 for use and folding of the structure 1 for storage.

Each of the tent poles 90 for the embodiment shown in FIG. 6 is arranged in three sections or stages, each stage comprised of telescoping members. Again, telescoping members similar to the stages 148, 149 and 150 are known in the art and a detail description of the telescoping mechanism is believed to be unnecessary. Typically the mechanism locks the parts in a first extended position and a button release 115 is provided to close the parts together.

For purposes of this disclosure, a first stage 148 is associated with the distal end 144 of the pole 90. Stage 148 is a two part telescoping stage and one part of the telescoping stage 148 is connected to a second telescoping stage 149. As indicated above, telescoping arrangement per se is known in the art and a detail description of the particular mechanism used in conjunction with the tent pole 90 is believed to be unnecessary. Stage 149 also is a two part telescoping stage and one part of stage 149 is connected to stage 148 while a second part is rotatably attached to a knuckle joint 160 at a first connection point of the joint 160. A third stage of the pole 90 also is a two part telescoping stage 150. A first end or part of the stage 150 is connected to a second connection point of the joint 160 and a second part of the stage is attached to the hub 88. That is to say, each of the poles 90 comprises three telescoping stages 148, 149 and 150, two of the stages (148, 149) being connected together, one end of which forms the distal end of the pole 90. The third stage 150 has a first end attached to the hub 88 while a second end is connected to the second and first stages at the knuckle joint 160 which permits rotation of the first and second stages 148, 149 from a position remote from the third stage 150 to a second position adjacent the third stage 150.

In moving from the deployed position for the tent, stage 149 of each of the poles 90 is collapsed within the respective parts, and then stage 148 is collapsed with the respective parts. The structure will then collapse. Stage 150 is then collapsed within its respective parts. The collapsed stages 148 and 149 are then rotated about the joint 160 so that stages 148 and 149 are adjacent stage 150. The three stages then are rotated to a vertical position about the hub 88 to the position illustratively shown in FIG. 15B and the material 10 is gathered about the poles. In erecting the tent, the procedure is reversed and again the action of the poles 90 on the hub 88 acts to raise the hub and its attached material 10 to a fully deployed position.

Figure 16A:
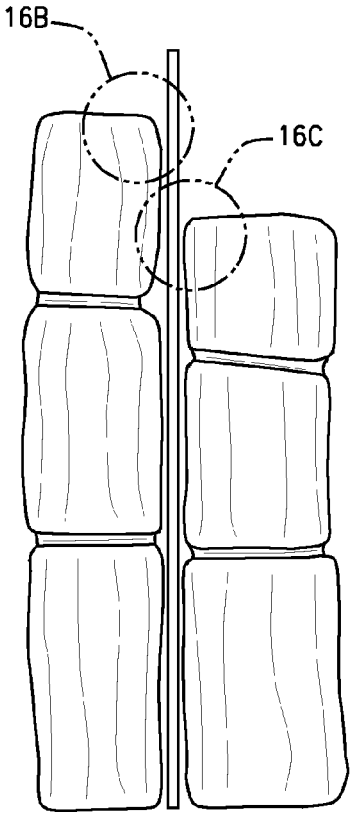
FIGS. 16A-16C are views in perspective of the packing size of a prior art tent system commonly known as a dome tent with the dome tent of the present disclosure shown in FIG. 2, showing the dramatic decrease in the packing size of the tent system of the present disclosure.
Figure 16B:
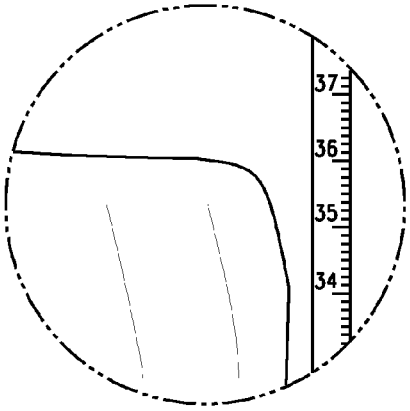
FIG. 16B PRIOR ART
Figure 16C:
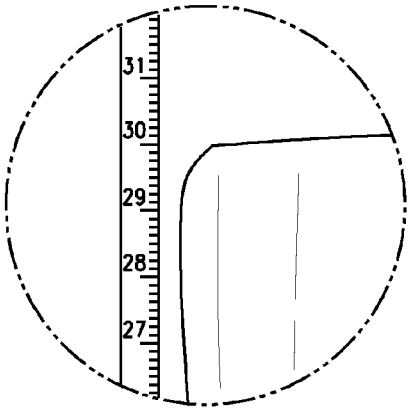
Figure 17A:
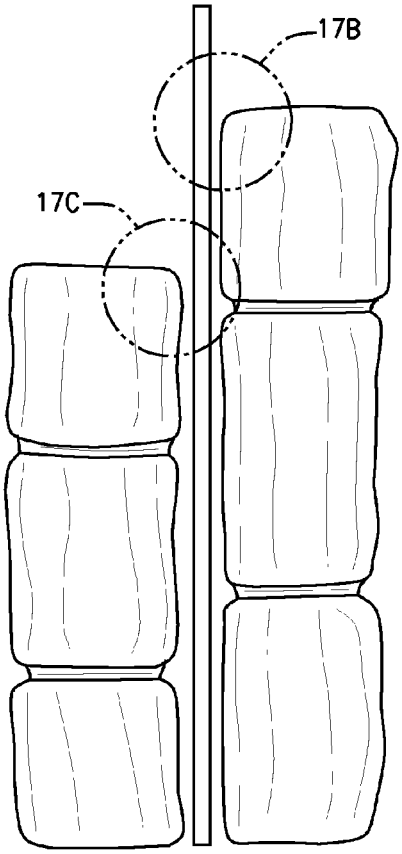
FIGS. 17A-17C are views in perspective of the packing size of a prior art tent system commonly known as a cabin tent with the cabin tent shown in FIG. 6, showing the dramatic decrease in the packing size of the tent system for the cabin tent of the present disclosure.
Figure 17B:
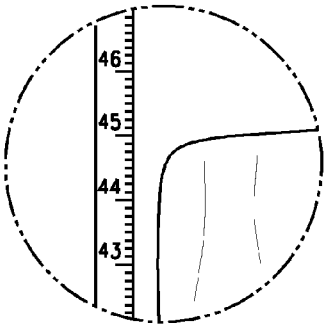
FIG. 17B PRIOR ART
Figure 17C:
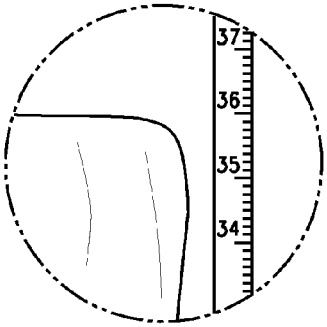

The functioning of the pole structure for each or the embodiments discussed above is important in achieving the compact package with the structure of the present disclosure. FIG. 16A-16C is a comparison of the dome tent size arranged for storage. As shown in FIG. 16B, prior art dome tent constructions typically are compact to approximately 37 inches. The frame structure 4 of the present disclosure compacts to approximately 30 inches. The difference is substantial considering the fact that the footprints of the erected tents are the same, but in the stored position, shipping charges, shipping capacity and display arrangements are all substantially better with the reduced package size.

Likewise, the cabin tent construction achieves a reduced size of approximately 36 inches while prior are designs typically were approximately 45 inches. Again the footprint of the erected tents are the same, but in the stored position, shipping charges, shipping capacity and display arrangement are all substantially better with the reduced package size.

As various changes could be made in the above constructions without departing from the scope of the invention, it is intended that all matter contained in the above description or shown in the accompanying drawings shall be interpreted as illustrative and not in a limiting sense. Numerous variations will occur to those skilled in the art in view of the forgoing description and accompanying drawings. Merely by way of example and not of limitation, the physical design of the hub may vary in other embodiments of the invention. While hub structures having four tent poles were discussed, hub structures having additional or fewer tent pole configurations are compatible with the broader aspects of the disclosure. Likewise, while various configurations were described, other configurations altered from the illustrated designs will function within the scope of the appended claims. In addition, the dimensions and arrangement of the legs of the hubs 8 and 88 themselves, or specific construction features of the poles described maybe varied. These variations are merely illustrative.

In view of the above, it will be seen that the several objects and advantages of the present invention have been achieved and other advantageous results have been obtained.

Having thus described the invention, what is claimed and desired to be secured by Letters Patent is:

1. A tent support system for a portable structure in the form of a tent including a frame structure defining the tent support system, the frame structure being moveable between a storage position and an extended position, comprising:

a spider like hub having a cylindrical central body having a vertical axis, the body having a plurality of legs extending outwardly from the body, each leg comprising a first pair of substantially planar opposed side walls, and a pair of opposed lips horizontally and vertically spaced from one another with respect to the vertical axis and arranged to define an open downwardly extending channel through the leg, the channel having a mouth sized to receive a tent pole and an exit void defined by the opposed side walls and the opposed lips arranged to permit rotational movement of the tent pole, the tent pole being captured between and engaged by the opposed lips in the extended position of the frame structure so that an upward force on the tent pole acts to lift the body of the spider hub, the tent pole being mounted for rotation between the extended position along the captured position of the pole between the opposed lips and a storage position disengaged from the opposed lips;

a plurality of tent poles corresponding to an equal number of the plurality of legs of the hub, each pole having a first end pivotally mounted between the oppositely opposed side walls and adopted to be captured between the opposed lips in at least one position of rotation in which a second distal end of each pole is intended for engagement with the ground so as to provide a substantially self-erecting frame structure;

an end termination for each tent pole, the end termination having a housing including an external surface guide having a flat formed in it, the flat adapted to engage one of the opposed lips of the hub in the erected position of the portable structure; and a flexible material associated with the frame structure for defining the physical contours of the portable structure, the flexible material being attached to at least the hub and the distal end of the tent pole plurality.

2. The tent support system of claim 1 wherein each tent pole has three stage sections, each of the three stage sections being telescopically associated with one another to permit the poles to define a first length in the extended position of the poles and a second length in the storage position of the poles, the second length being approximately one third of the first length.

3. The tent support system of claim 1 wherein each tent pole comprises three stage sections, one stage section being engaged with the hub and a second stage section defined by a telescoping pole extendable between a first stored position and a second extended positioned, the third pole stage section being joined between the first and second stage pole sections by a pair of knuckle mechanisms permitting folding of the second stage pole section on the third stage pole section and the second and third stage pole sections on the first stage pole section to define a storage position for the stage pole sections.

4. The tent support system of claim 1 wherein each tent pole comprises four stage sections, one stage section being engaged with the hub and a second stage section defined by a telescoping pole extendable between a first stored position and a second extended position, a third stage pole section attached to the second stage pole section by a mechanism locking the third stage pole section in position with respect to the second stage pole section in the extended position of the tent pole and preventing both clockwise and counterclockwise rotation in the extended position of the tent pole and adopted to permit release of and counterclockwise rotation of the second stage pole section with respect to the third stage pole section to define a storage position for the second stage pole section with respect to the third stage pole section.

5. The tent support system of claim 4 wherein the mechanism permitting counterclockwise rotation for storage comprises a first part adapted to receive an end of the second stage pole section and releasable locking the second stage pole section in an extended position to prevent further clockwise rotation of the second stage pole section during erecting of the frame structure but permits axial relative movement of the second stage pole section to permit counter clockwise rotation for storage.

6. The tent support system of claim 5 wherein each tent pole has four stage sections, each of the four stage sections being associated with one another to permit the poles to define a first length in the extended position of the poles and a second length in the storage position of the poles, the second length being approximately one fourth of the first length.

7. The tent support system of claim 6 wherein the tent pole is mounted for rotation to the walls of the legs along an axis of rotation positioned above the void.

8. The tent support system of claim 7 further including a separate rain fly attached to the tent poles.

9. The tent support system of claim 8 wherein the rain fly is generally rectangular and the flexible material is attached to the rain fly.

10. A portable structure support system including a frame structure, the frame structure having a stored position and an extended position, comprising:

a hub having a central body having a vertical axis, the body having a plurality of legs extending outwardly and downwardly from the body, each leg comprising a first pair of opposed side walls, and a pair of opposed lips both horizontally and vertically spaced from one another with respect to the vertical axis, arranged to define a channel extending through the leg, the channel having a mouth sized to receive a supporting pole, and an enclosed exit void bounded and defined by the opposed side walls and the opposed lips and arranged to permit rotational movement of the supporting pole, the pole being captured between the opposed lips in an extended position of the poles so that a force on the supporting pole acts to lift the body of the hub, the supporting pole being mounted for rotation between the extended position along the captured position of the supporting pole between the opposed lips and storage position disengaged from the opposed lips;

a plurality of supporting poles corresponding to an equal number of the plurality of legs of the hub, the supporting poles adapted to compact in the storage position to a reduced length less than half of their extended length, each supporting pole defining at least three stages, two of the stages joined by an assembly mechanism including an end piece attached to one stage and a connector body attached to the other stage, the interconnection between the end piece and the connector body being movable with respect to one another to define at least a first inserted fixed position and second rotational position such that in the inserted fixed position rotation of the associated tent pole stages with respect to the joint in either a clockwise or counterclockwise direction is prevented while in the second position only counterclockwise rotation is permitted, each pole also having a first end pivotally counted between the oppositely opposed side walls and adopted to be captured between the opposed lips in at least on position of rotation in which a second distal end of each pole is intended for engagement with the ground to provide a substantially self-erecting frame structure, the first end of each tent pole terminating with a surface adapted to engage one of the opposed lips of the hub in the erected position of the portable structure; and a flexible material associated with the supporting legs for defining the physical contours of the portable structure, the flexible material being attached to at least the hub and the distal end of the tent pole plurality.

11. The support system of claim 10 wherein each pole comprises four stage sections, one section being engaged with the hub and a second section defined by a telescoping pole extendable between a first stored position and a second extended position, a third pole section attached to the second pole section by the assembly mechanism permitting counterclockwise rotation of the second pole section with respect to the third pole section.

12. The support system of claim 11 wherein the assembly mechanism permitting counterclockwise rotation comprises a first part adapted to receive an end of the second pole section and releaseably locking the second pole section in extended fixed position to prevent further clockwise rotation of the second pole section.

13. The support system of claim 12 wherein each pole has four stage sections, each of the four stage sections being associated with one another to permit the poles to define a first length in the extended position of the poles and a second length in the storage position of the poles, the second length being approximately one fourth of the first length.

14. The support system of claim 10 wherein the pole is mounted for rotation to the walls of the legs along an axis of rotation positioned above the void.

* * * * *